US007699651B2

(12) United States Patent
Rosenberger et al.

(10) Patent No.: US 7,699,651 B2
(45) **Date of Patent: *Apr. 20, 2010**

(54) BULKHEAD SOCKET FOR A CO-AXIAL PLUG AND SOCKET CONNECTOR

(75) Inventors: Bernd Rosenberger, Tittmoning (DE); Christian Entsfellner, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 493 days.

This patent is subject to a terminal disclaimer.

(21) Appl. No.: 11/569,019

(22) PCT Filed: May 11, 2005

(86) PCT No.: PCT/EP2005/005091

§ 371 (c)(1),
(2), (4) Date: Nov. 13, 2006

(87) PCT Pub. No.: WO2005/114794

PCT Pub. Date: Dec. 1, 2005

(65) Prior Publication Data

US 2008/0261444 A1 Oct. 23, 2008

(30) Foreign Application Priority Data

May 17, 2004 (DE) ..... 20 2004 007 909 U

(51) Int. Cl.
*H01R 9/05* (2006.01)

(52) U.S. Cl. ..... 439/578; 439/352; 439/353; 439/357

(58) Field of Classification Search ..... 439/578, 439/350, 352, 353, 354, 357, 358
See application file for complete search history.

(56) References Cited

U.S. PATENT DOCUMENTS

| | | | | |
|---|---|---|---|---|
| 5,074,809 | A | 12/1991 | Rousseau et al. | |
| 5,176,533 | A | 1/1993 | Sakurai et al. | |
| 5,746,619 | A | 5/1998 | Harting et al. | |
| 6,439,925 | B1 | 8/2002 | Lin et al. | |
| 7,201,608 | B2 * | 4/2007 | Rosenberger et al. | 439/578 |
| 2002/0019161 | A1 | 2/2002 | Finke et al. | |

FOREIGN PATENT DOCUMENTS

| | | |
|---|---|---|
| CH | 340 537 | 8/1959 |
| GB | 1 199 104 | 7/1970 |
| JP | 2004-079425 | 3/2004 |

* cited by examiner

*Primary Examiner*—Javaid Nasri
(74) *Attorney, Agent, or Firm*—Lowe Hauptman Ham & Berner LLP

(57) ABSTRACT

A coaxial plug and socket connector includes a coaxial plug and a bulkhead socket. The socket has: an outer conductor shell, and coaxial cable and mating ends. The shell inside wall, adjacent the mating end, has a latching edge groove. The plug has: an outer conductor shell having mating and coaxial cable ends, a latching sleeve fitting round and axially displaceable relative to the plug shell. The latching sleeve has axial slots at its mating end forming elastically resilient latching tongues having, at their mating ends, a latching edge extending radially outwardly to latch onto the socket groove latching edge. An unlocking sleeve surrounding and displaceable axially relative to the latching sleeve has a ramp sloping radially outwardly toward the cable end. The ramp cooperates with a groove on an inside face of the unlocking sleeve so unlocking sleeve displacement relative to the latching sleeve bends the tongues inwardly.

5 Claims, 4 Drawing Sheets

BULKHEAD SOCKET FOR A CO-AXIAL PLUG AND SOCKET CONNECTOR

RELATED APPLICATIONS

The present application is based on, and claims priority from, German Application Number 20 2004 007 909.7, filed May 17, 2004, and PCT/EP2005/005091, filed May 11, 2005, the disclosures of which are hereby incorporated by reference herein in their entirety.

FIELD OF THE INVENTION

The present invention relates to a bulkhead socket for a co-axial plug and socket connector, particularly of the N-type, having a cylindrical shell which forms an outer conductor and has a co-axial cable end and a mating end. The invention also relates to a coaxial plug and socket connector having a co-axial plug and a bulkhead socket, in particular of the N type.

BACKGROUND OF THE INVENTION

Co-axial plug and socket connectors comprise a co-axial plug and a co-axial bulkhead socket which, when plugged together and connected to one another, produce co-axial plug-in contact. To allow a plug and socket to be connected in the case of co-axial plug and socket connectors of the so-called N type, the socket has a thread on its outer circumference. The plug is fitted with a union nut which likewise has a thread, on its inner circumference. An N plug and an N socket are connected by being plugged together and a union nut of the N plug is screwed, by its inside thread, onto an outside thread on the N socket. The connection of co-axial plug and socket connectors of the N type in this way has long been known and provides a good and secure HF contact between the plug and socket. However, it is often felt to be a disadvantage that a screwing operation which takes a relatively large amount of manual effort and a relatively long time has to be performed to connect the plug and socket. In applications where, for example, a large number of co-axial connections have to be made between plugs and sockets, the manual effort and time spent adds up to a considerable total.

SUMMARY OF THE INVENTION

An object of the present invention is to simplify the connecting and disconnecting operations of a bulkhead socket or a co-axial plug and socket connector, the intention being for reliability in operation to be preserved in full with regard to the transmission of HF signals.

This object is achieved in accordance with an aspect of the invention by a bulkhead socket of the above-mentioned kind having a cylindrical shell which forms an outer conductor and has a co-axial cable end and a mating end, wherein a groove on an inside wall of the shell, adjacent the mating end, has an annular shape and a latching edge.

Another aspect of the invention relates to a co-axial plug and socket connector of the above-mentioned kind having a co-axial plug and a bulkhead socket, wherein the bulkhead socket includes the features mentioned in the previous paragraph.

Hence, in a bulkhead socket of the above-mentioned kind, provision is made for a groove which has an annular shape on an inside wall of the shell, adjacent the mating end.

This has the advantage that a co-axial plug having an elastically resilient latching part which fits into the groove in the shell can be fastened to the bulkhead socket.

In a preferred embodiment, a mating end of the groove, which mating end forms the latching edge, is spaced 2.8 mm to 3 mm, and in particular 2.9 mm, away from the mating end of the bulkhead socket.

The shell usefully has on its outer circumference a thread for engaging an inside thread in a union nut belonging to a conventional co-axial plug. In this way, the bulkhead socket can, if desired, also be connected to a standard conventional co-axial plug which has screwed fastening means.

In a co-axial plug and socket connector of the above kind, provision is made in accordance with the invention for the bulkhead socket to be formed as described above.

This has the advantage that the co-axial plug-in connection can be connected and disconnected again easily, quickly and with an assurance of reliable operation without screwed connections having to be operated.

In a preferred embodiment, the co-axial plug comprises a cylindrical outer-conductor part of its shell which forms an outer conductor and which has a mating end and a co-axial cable end. A latching sleeve which fits around the outer-conductor part of the shell is axially displaceable relative to the outer-conductor part of the shell. A spring is supported by one of its ends against the outer-conductor part of the shell and by its other end against the latching sleeve, in such a way that the latching sleeve is pre-loaded in the direction of the co-axial cable end of the outer-conductor part of the shell. The latching sleeve has axial slots at its mating end so that elastically resilient latching tongues are formed. Each of the latching tongues has at its mating end, a latching edge which extends upwardly in a radial outward direction, to latch onto the latching edge of the groove in the bulkhead socket. An unlocking sleeve which surrounds the latching sleeve and is displaceable axially relative to the latching sleeve has a ramp which (1) extends upwardly in a radial outward direction and (2) slopes upwardly in the direction of the co-axial cable end. The ramp co-operates with a correspondingly beveled groove in an inside face of the unlocking sleeve in such a way that displacement of the unlocking sleeve relative to the latching sleeve in the direction of the co-axial cable end causes the latching tongues of the latching sleeve to bend radially inward.

A stop for the latching sleeve is formed at the co-axial cable end of the outer-conductor part of the shell. The stop sets a limit for axial movement of the latching sleeve in the direction of the co-axial cable end of the outer-conductor part of the shell.

BRIEF DESCRIPTION OF THE DRAWING

A preferred embodiment of the invention is described in detail below by reference to the drawings. In the drawings.

DETAILED DESCRIPTION OF THE DRAWING

Figure 1:
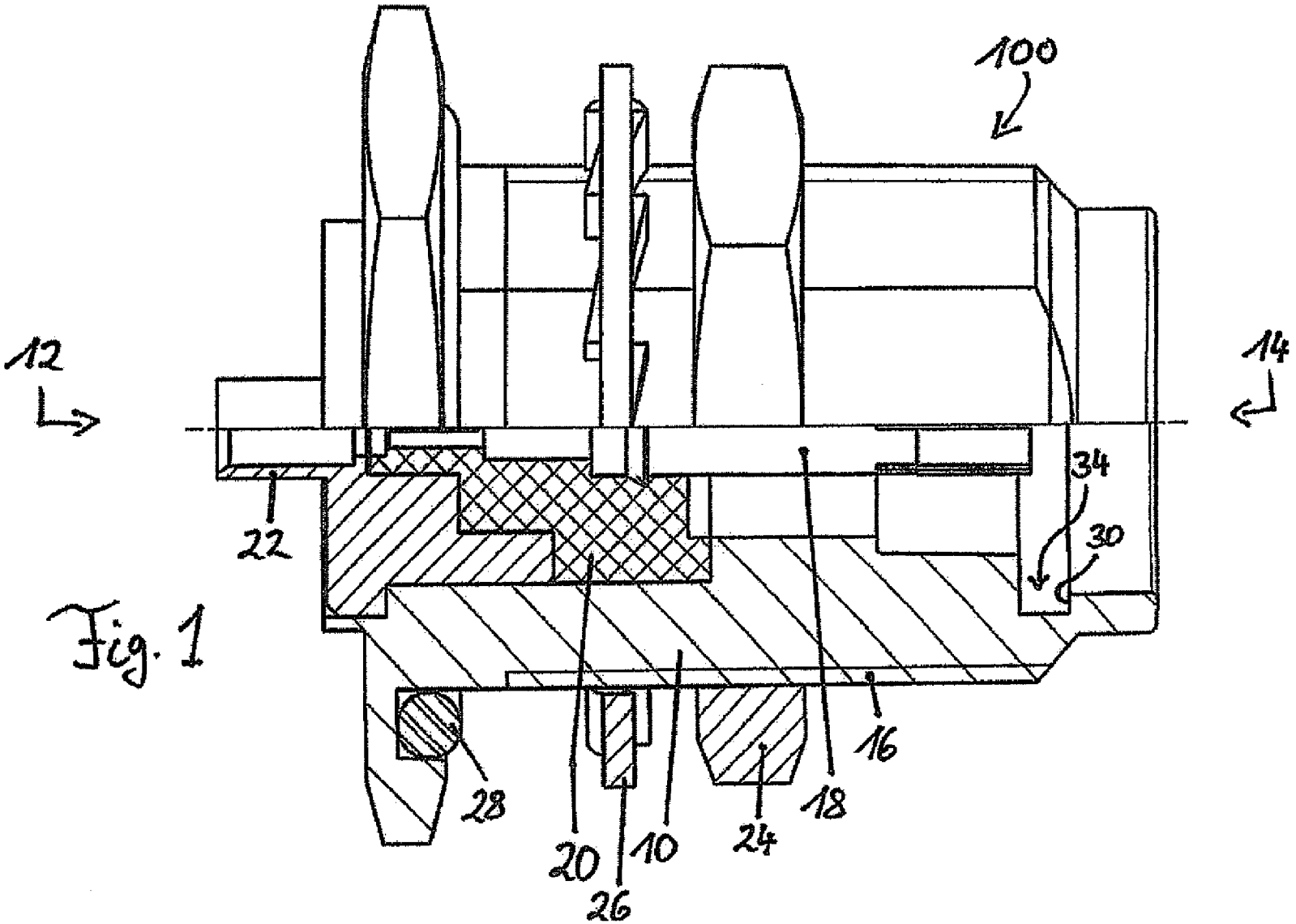
FIG. 1 is a side view, partly in section, of a preferred embodiment of bulkhead socket according to the invention.

FIG. 1 is a diagram of a bulkhead socket 100 of the N type for a co-axial plug and socket connector. Socket 100 has a cylindrical shell 10 which forms an outer conductor. Shell 10 has a co-axial cable end 12, a mating end 14, and, on its outer circumference, an outside thread 16. The bulkhead socket 100 also comprises a centre conductor 18, an insulating part 20, a female solder connection 22, a hexagonal nut 24, a shakeproof washer 26 (i.e. lock washer) and an O-ring 28.

This N-type bulkhead socket 100 is of a standard design, except as follows: at the mating end 14, there is formed in the inner circumference of the shell 10, a latching edge 30. Latching edge 30 is formed as an edge of groove 34 which extends around in an annular shape on an inside face of the shell 10 that is at right angles to the longitudinal axis of socket 100. The groove 34 is formed by stock-removing machining of the standard inner circumference of the shell 10, at the mating end 14. This non-standard configuration of the inner circumference of the shell 10 at the mating end 14 is such that operation is not adversely affected in any way when a conventional co-axial plug having a union nut is plugged in. Hence, even a standard N-type co-axial plug having an internally threaded union nut can be fastened to bulkhead socket 100 as shown in FIG. 1.

Because of the design of bulkhead socket 100, it is also possible to plug in a specially designed co-axial plug of the quick-action fastening type. This special co-axial plug has a latching element which engages behind the latching edge 34 and, in co-operation with the latching edge 34, makes a mechanically firm connection between the bulkhead socket and the co-axial plug.

Figure 2:
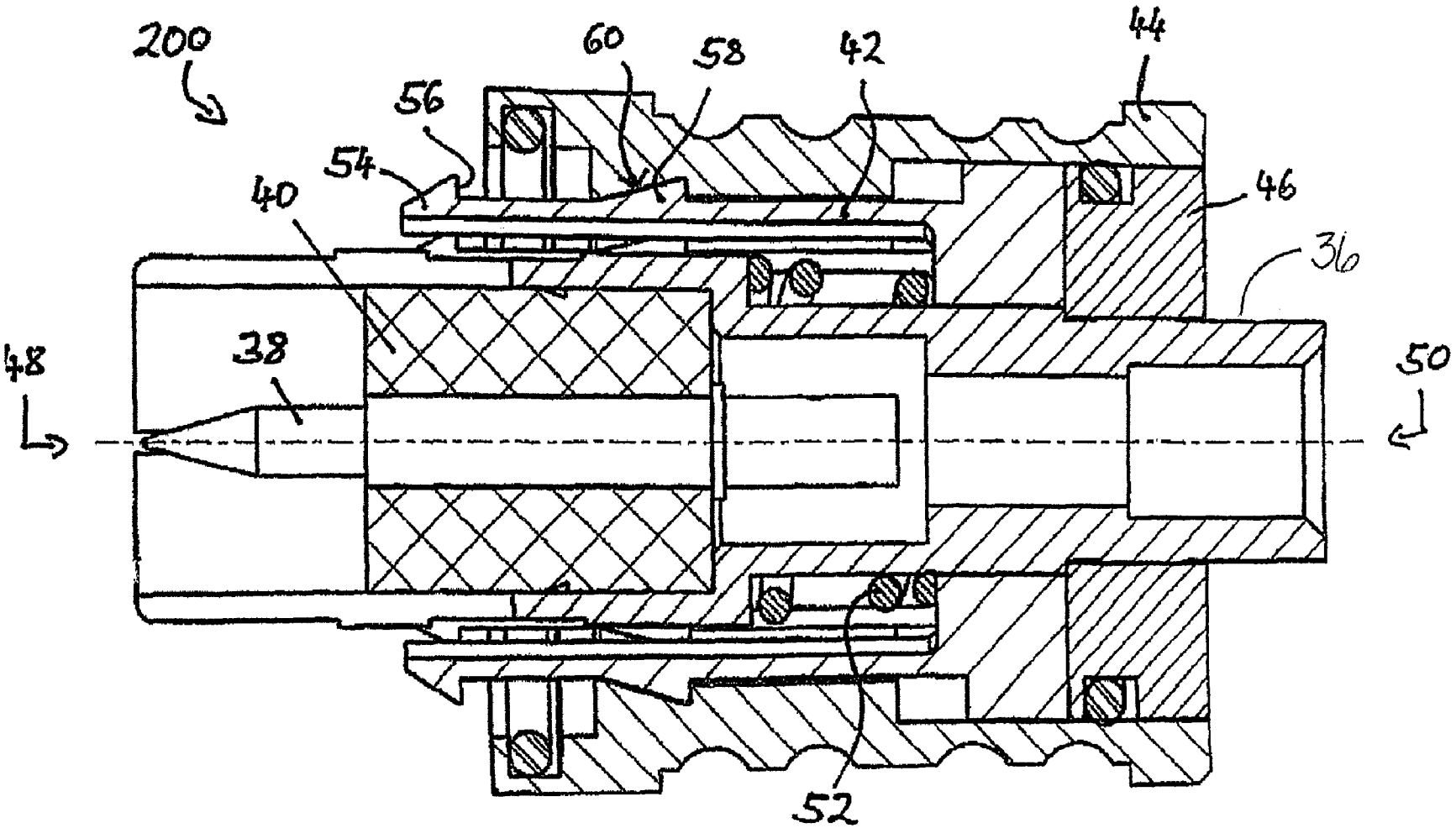
FIG. 2 is a view in section of a co-axial plug which fits the bulkhead socket shown in FIG. 1.
Figure 2A:
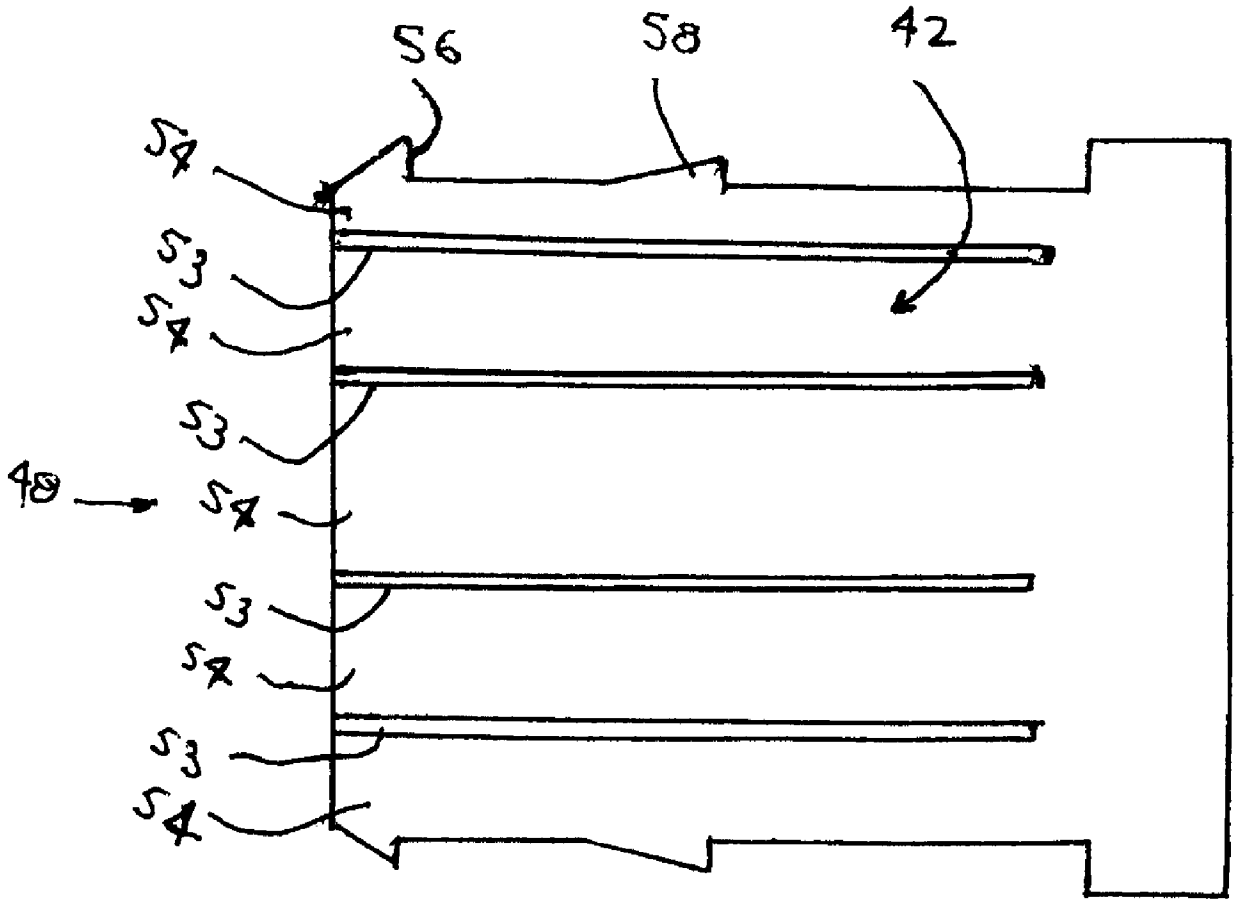
FIG. 2A is a side view of a latching sleeve in the plug of FIG. 2.

A specially designed co-axial plug 200 of this kind is shown by way of example in FIG. 2 and comprises a cylindrical outer-conductor part 36 of the shell which forms an outer conductor, a centre conductor 38, an insulating part 40, a latching sleeve 42, an unlocking sleeve 44 and a compression ring 46. The outer-conductor part 36 of the shell has a mating end 48 and a co-axial cable end 50. The latching sleeve 42 fits round the outer-conductor part 36 of the shell. A spring 52 is provided which is supported by one of its ends against the outer-conductor part 36 of the shell and by other end against the latching sleeve 42, in such a way that the latching sleeve 42 is pre-loaded in the direction of the co-axial cable end 50 of the outer-conductor part 36 of the shell. At the co-axial cable end 50 of the outer-conductor part 36 of the shell, there is formed a stop for the latching sleeve 42 in the form of the compression ring 46, which sets a limit for axial movement of the latching sleeve 42 in the direction of the co-axial cable end 50 of the outer-conductor part 36 of the shell. At its mating end 48, the latching sleeve 42 is formed to have axial slots 53 (FIG. 2A), thus producing elastically resilient latching tongues 54. At their mating ends, these latching tongues 54 each have a latching edge 56 which extends upwards in a radially outward direction. The unlocking sleeve 44 surrounds the latching sleeve 42 and is axially displaceable relative to the latching sleeve 42. The latching sleeve 42 has a ramp 58 which extends upwards in a radially outward direction and which slopes up in the direction of the co-axial cable end 50, which ramp 58 co-operates with a correspondingly bevelled groove 60 in an inside face of the unlocking sleeve 44 in such a way that displacement of the unlocking sleeve 44 relative to the latching sleeve 42 in the direction of the co-axial cable end 50 causes the latching tongues 54 of the latching sleeve 42 to be bent radially inwards.

Figure 3:
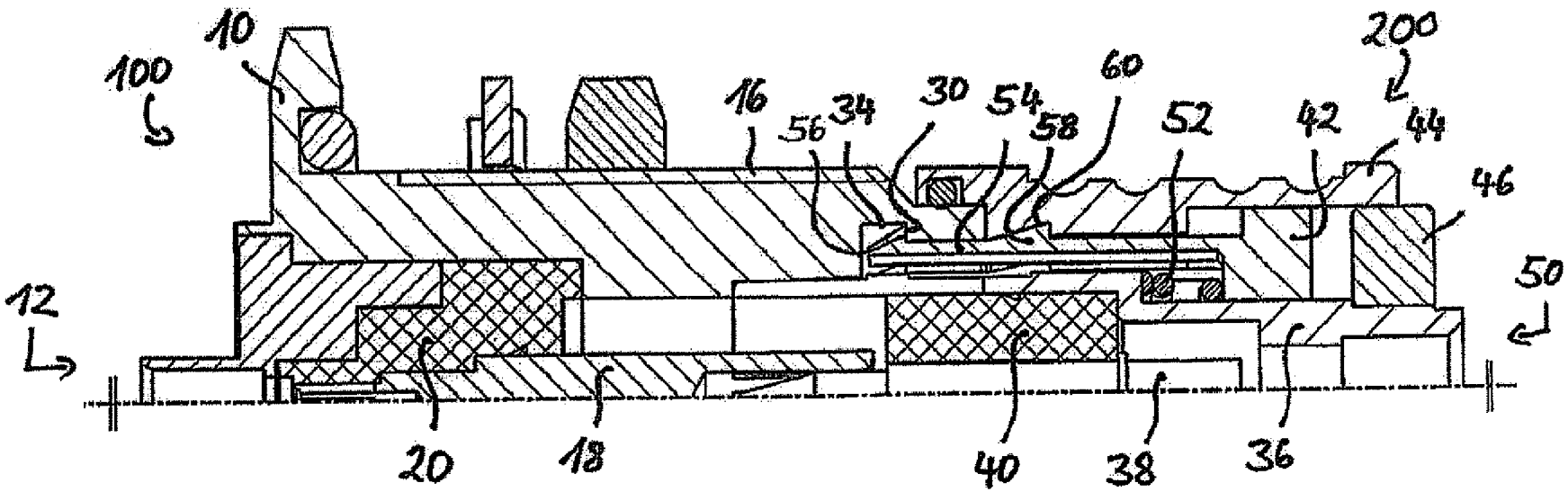
FIG. 3 is a view in section of the bulkhead socket of FIG. 1 and the co-axial plug of FIG. 2, in the plugged-together state.

FIG. 3 is a diagram of the way the locking mechanism between the bulkhead socket 100 and the co-axial plug 200 operates, parts which perform the same functions being denoted by the same reference numerals as in FIGS. 1 and 2, for which reason reference should be made to the above description of FIGS. 1 and 2 for a description of them.

In the plugged-in state, the latching tongues 54 having the latching edges 56 engage behind the latching edge 30 of the groove 34. This produces a locking retention between the bulkhead socket 100 and the co-axial plug 200 without a screwed connection having to be made for this purpose. Instead, the co-axial plug 200 merely has to be pushed into the bulkhead socket 100. Because the latching edge 56 has a ramp-like configuration, edge 56 automatically slides past the latching edge 30, the latching tongues 44 being bent radially inwards elastically, and into groove 34. The unlocking sleeve 44 is used to release this latched mechanical connection again. For this purpose, the unlocking sleeve 44 is displaced axially, relative to the latching sleeve 42; or in other words relative to the outer-conductor part 36 of the shell, in the direction of the co-axial cable end 50 of the co-axial plug 200. Because of this, the beveled groove 60 slides over the ramp 58 on the latching sleeve 42, whereby the latching tongues 54 are bent radially inwards. This causes the latching edge 56 to be freed from its engagement with the latching nose 30, thus enabling the co-axial plug 200 to be withdrawn from the bulkhead socket 100.

The co-axial plug 200 which fits the bulkhead socket 100 has the following configuration.

Co-axial plug 200 for a co-axial plug and socket connector, particularly of the N type, comprises a cylindrical outer-conductor part 36 having a (1) shell which forms an outer conductor (2) a mating end 48 and (3) a co-axial cable end 50. Latching sleeve 42 fits around the outer-conductor part 36 of the shell and is axially displaceable relative to the outer-conductor part 36 of the shell. Spring 52 is supported by one of its ends against the outer-conductor part 36 of the shell and by its other end against the latching sleeve 42, in such a way that the latching sleeve 42 is pre-loaded in the direction of the co-axial cable end 50 of the outer-conductor part 36 of the shell. The latching sleeve 42 has axial slots at its mating end 48 so that elastically resilient latching tongues 54 are formed. Each latching tongue 54 has, at its mating end, a latching edge 56 which extends upwardly in a radially outward direction. An unlocking sleeve 44 surrounds the latching sleeve 42 and is displaceable axially relative to the latching sleeve 42. The latching sleeve 42 has a ramp 58 which extends upwardly in a radially outward direction and which slopes up in the direction of the co-axial cable end 50. Ramp 58 co-operates with a correspondingly beveled groove 60 in an inside face of the unlocking sleeve 44 in such a way that displacement of the unlocking sleeve 44 relative to the latching sleeve 42 in the direction of the co-axial cable end 50 causes the latching tongues 54 of the latching sleeve 42 to bend radially inwardly.

Co-axial plug and socket connector 200, as described in the previous paragraph, are formed so that, at the co-axial cable end 50 of the outer-conductor part 36 of the shell, there is a stop 46 for the latching sleeve 42. Stop 46 sets a limit for axial movement of the latching sleeve 42 in the direction of the co-axial cable end 50 of the outer-conductor part 36 of the shell.

The invention claimed is:

1. Co-axial plug and socket connector comprising: a co-axial plug and a bulkhead socket of the N type;

the bulkhead socket having (a) an outer conductor including a cylindrical shell, (b) a co-axial cable end and (c) a mating end; an inside wall of the shell, adjacent the mating end, including a groove which extends round in an annular shape and which forms a latching edge;

the co-axial plug comprising (a) an outer conductor including a cylindrical outer-conductor part of its shell and which has a mating end and a co-axial cable end, (b) a latching sleeve which fits round the outer-conductor part of the shell of the plug and is axially displaceable relative to the outer-conductor part of the shell of the plug, a spring having a first end bearing against the outer-conductor part of the shell of the plug and a second end bearing against the latching sleeve so the latching sleeve is pre-loaded in the direction of the co-axial cable end of the outer-conductor part of the shell, the latching sleeve having axial slots at its mating end so that elastically resilient latching tongues are formed, said latching tongues each having, at their mating ends, a latching edge which extends in a radially outward direction, to latch onto the latching edge of the groove in the bulkhead socket, and an unlocking sleeve surrounding the latching sleeve and displaceable axially relative to the latching sleeve, the latching sleeve having a ramp which slopes in a radially outward direction toward the co-axial cable end, the ramp co-operating with a correspondingly beveled groove on an inside face of the unlocking sleeve so that displacement of the unlocking sleeve relative to the latching sleeve in the direction of the co-axial cable end causes the latching tongues of the latching sleeve to bend radially inward.

2. Co-axial plug and socket connector according to claim 1 wherein a mating end of the groove forms the latching edge, the groove being spaced 2.8 mm to 3 mm away from the mating end of the bulkhead socket.

3. Co-axial plug and socket connector according to claim 1 wherein a mating end of the groove forms the latching edge, the groove being spaced 2.9 mm away from the mating end of the bulkhead socket.

4. Co-axial plug and socket connector according to claim 1, wherein the shell has on its outer circumference a thread for engaging an inside thread of a union nut of a conventional co-axial plug.

5. Co-axial plug and socket connector according to claim 1, further including a stop for the latching sleeve at the co-axial cable end of the outer-conductor part of the shell, said stop being arranged to set a limit for axial movement of the latching sleeve in the direction of the co-axial cable end of the outer-conductor part of the shell.

* * * * *